United States Patent [19]

Foults, deceased

[11] 4,169,421

[45] Oct. 2, 1979

[54] APPARATUS FOR AFFIXING SLIDE FASTENER ELEMENTS TO FABRIC

[75] Inventor: Jonathan A. Foults, deceased, late of Wolcott, Conn., by Patricia L. Foults, executrix

[73] Assignee: Scovill Manufacturing Company, Waterbury, Conn.

[21] Appl. No.: 921,745

[22] Filed: Jun. 3, 1978

Related U.S. Application Data

[63] Continuation of Ser. No. 778,742, Mar. 17, 1977, abandoned.

[51] Int. Cl.[2] ..... D05B 97/10; D05B 37/06

[52] U.S. Cl. ..... 112/104; 112/130; 112/265.2

[58] Field of Search ..... 112/104, 105, 113, 115, 112/265, 130

[56] References Cited

U.S. PATENT DOCUMENTS

| | | | |
|---|---|---|---|
| 3,244,129 | 4/1966 | Steingruebner | 112/130 X |
| 3,750,603 | 8/1973 | Martin | 112/130 X |
| 3,755,879 | 9/1973 | Cuckson | 112/265 X |

*Primary Examiner*—Werner H. Schroeder
*Assistant Examiner*—Andrew M. Falik
*Attorney, Agent, or Firm*—Dallett Hoopes

[57] ABSTRACT

Attachment for sewing machine is driven by the needle bar and includes knife which engages and feeds step-by-step fashion the fastener ladder through machine as machine stitches it to fabric. Means on the attachment are provided to selectively drive knife into deeper engagement with ladder to sever ladder at end of slide fastener. Computer/control devices are provided.

9 Claims, 23 Drawing Figures

Fig. A.

APPARATUS FOR AFFIXING SLIDE FASTENER ELEMENTS TO FABRIC

This is a continuation of application Ser. No. 778,742, filed Mar. 17, 1977 now abandoned.

BACKGROUND OF THE INVENTION

1. Field of the Invention

This invention relates to an apparatus for affixing slide fastener elements to fabric, for instance, the fabric of a garment. More specifically, the invention relates to apparatus by which a "ladder" or line of slide fastener elements may be sewn to the fabric of a garment directly without the conventional intervening zipper tape.

2. Description of the Prior Art

In U.S. Pat. No. 3,755,879, issued Sept. 4, 1973 and assigned to the same assignee as this application, there was disclosed an apparatus for sewing "U"-shaped zipper elements directly to the fabric of a garment. While the apparatus disclosed in said patent is meritorious and desirable in every way, the present invention relates to an advancement, or improvement, on the apparatus disclosed in that patent.

SUMMARY OF THE INVENTION

Briefly, the apparatus of the present invention includes a sewing machine and attachment therefor, the attachment being adapted to not only feed lines of zipper tape through the sewing machine so that they may be sewn directly to the fabric, but also means for severing the line of fasteners after a predetermined length of line. Additionally, means may be provided by which the automatic operation of the machine of the invention may be effected so that the length of the zipper to be sewn may be set and its sewing affixation to the fabric may be effected including anchoring stitches at either end of the line of fasteners.

BRIEF DESCRIPTION OF THE DRAWINGS

Other features of the invention will be apparent from a study of the accompanying specification including the attached drawings, all of which disclose non-limiting embodiments of the invention. In the drawings.

FIG. A is an enlarged view transverse of a line of fasteners with which the invention is adapted to be used.

DETAILED DESCRIPTION OF THE PREFERRED EMBODIMENTS

A typical fastener element with which the invention is adapted to be used is shown in FIG. A. It comprises a "U"-shaped fastener element having an enlarged head H at its bight, legs L, and heels N. Notches O indent the legs adjacent the heels. This "U"-shaped element is of plastic and embedded in the heels are cords M running the length of the fastener elements and serving to immobilize the elements and uniformly space them. As in the past, the severing of such a line of fasteners is accomplished by simply cutting the cords M between adjacent elements where desired.

Figures 1, 2, 2A, 3, 4, 5, 6:
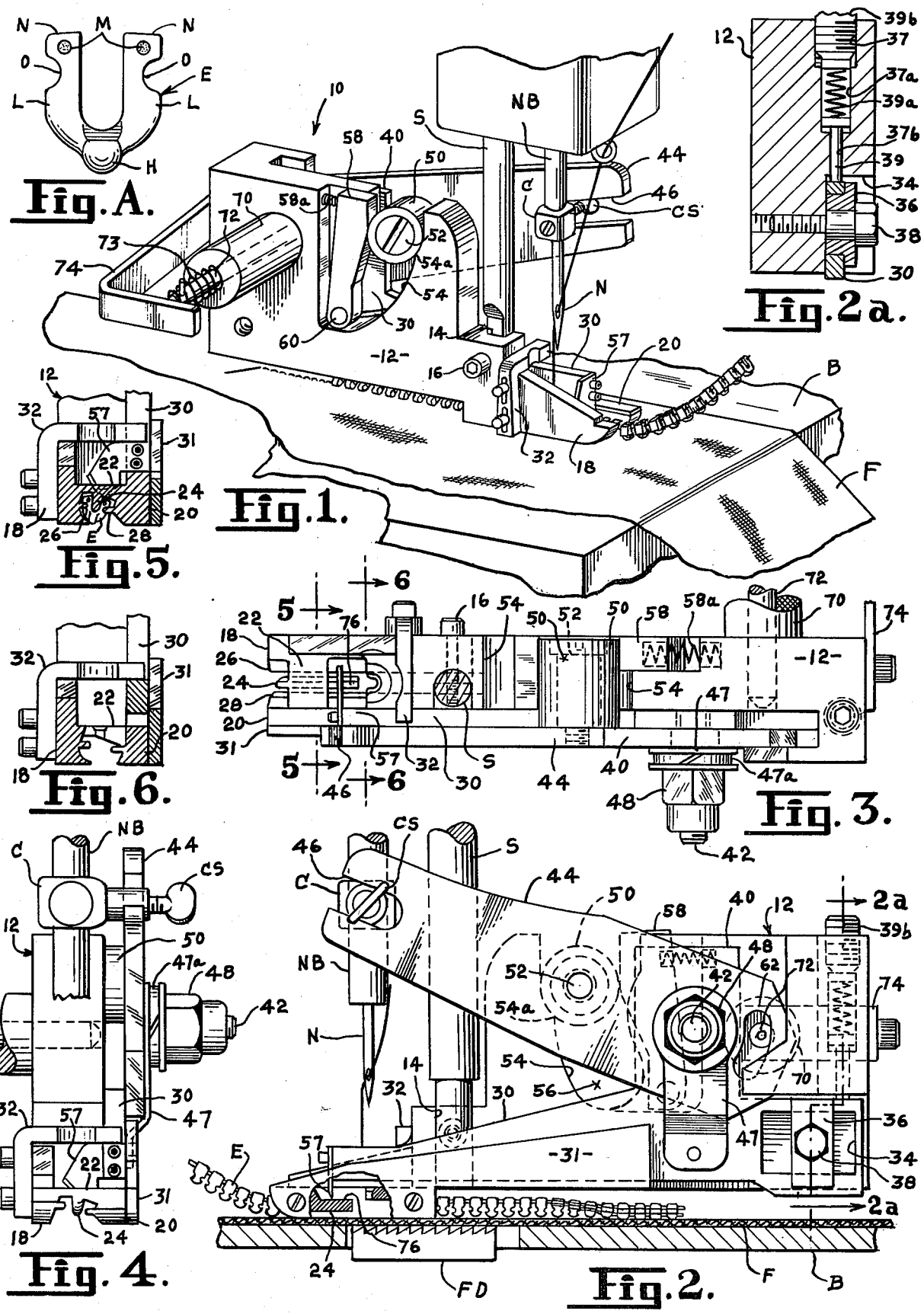
FIG. 1 is a perspective view of an attachment embodying the invention attached to a conventional sewing machine.
FIG. 2 is a side view of the attachment showing the adjacent parts of the sewing machine in fragmentary fashion and taken from the opposite side of the attachment from FIG. 1. The lower portion of the side of the attachment is broken away to show the knife guide means.
FIG. 2*a* is a section view taken on the line 2*a*–2*a* of FIG. 2.
FIG. 3 is a top view with respect to FIG. 2.
FIG. 4 is a front end view shown in fragmentary fashion.
FIG. 5 is a sectional view taken on the line 5—5 of FIG. 3.
FIG. 6 is a sectional view taken on the line 6—6 of FIG. 3.

As shown in FIG. 1, an apparatus embodying the invention is generally designated 10. It is adapted to be mounted on the presser foot shaft S of a standard sewing machine having a needle bar NB with clamp C and needle N working in cooperation with the sewing machine bed B. A conventional feed dog FD (FIG. 17) engages and moves fabric through the machine from the underside.

The apparatus comprises a frame 12 having a foot portion with a vertical opening 14 adapted to receive the presser foot shaft S to which the frame 12 may be secured by the clamping screw 16 disposed in a tapped hole intersecting the opening 14. The front end of the frame comprises a pair of pressing shoes 18 and 20. The shoes are joined by a web 22 having a depending spreader cam 24 (FIG. 5). To stabilize the fastener elements E as they move between the shoes 18 and 20 and are spread by the cam 24, the shoes may present inwardly extending flanges 26 and 28 which engage in the notches O (FIG. A).

Disposed above the shoe 20 in the front of the frame and mounted for movement reciprocally of the frame with some vertical movement as well, is the feed arm 30. Arm 30 rests against the right side of the frame 12. It is held thereagainst by the retainer plate 31. The front end of the arm 30 is confined to limited vertical movement by the stop finger 32 which is secured by bolts as shown to the leftward side of the frame 12 and extends up over the shoe 18 to present its distal end above the arm 30. In addition, the feed arm 30 is formed with a slot 34 adjacent the rear end of it.

The slot 34 receives a "T"-shaped spacer 36 which is bolted as by bolt 38 to the frame. The spacer 36 limits the vertical movement of the rear of the arm but permits horizontal reciprocal movement of the arm against the frame (see section *2a*).

As shown in FIG. *2a*, the frame 12 is drilled with successive smaller bores 37, **37*a*, 37*b* from its upper surface downward, the last bore 37*b* intersecting the cut-out for the rearward end of the arm 30. The last bore 37*b* receives a pin 39 which engages the upper surface of the arm 30. The pin 39 is headed at its upper end and is urged downwardly by a spring 39*a* disposed in bore 37*a* between the pin 39 and a set screw 39*b* which is adjustably disposed in tapped bore 37. The pressure exerted on the feed arm by the pin 39 serves to damp the motion of the arm 30 and also to slightly urge the forward end of the arm 30 upward and counterbalance the weight thereof. This assures that the knife 57** clears the elements E as the knife moves forward.

Thus, the feed arm 30 is confined to a limited horizontal movement as limited by the opening 34 at its rear end. At its forward end, the arm 30 is permitted slight vertical movement limited upwardly by the stop 32. Downwardly, the travel of the front end of arm 30 is limited, as will be described.

An upward extension 40 (FIg. 2) of the arm 30 mounts a perpendicularly outward threaded strud 42 which is received into an opening in the drive arm 44. The forward end of the drive arm 44 is slotted, as shown at 46, to receive the clamping screw CS of the needle clamp C.

A bracket 47, the lower end of which is attached to arm 30, a suitable compression washer **47*a* and a nut 48 are also received by the shaft 42 so that the drive arm 44 is pressed snugly against the feed arm 30. As a result, when the needle vertically reciprocates, as in a sewing motion, the drive arm 44 oscillates about the stud 42. This causes an up-and-down oscillating movement of the front end of the feed arm 30**.

Further controlling the motion of the feed arm 30 and drive arm 44 is the cam roller 50 which is mounted for free rotation on a spindle 52 on arm 44. A cam surface 54 is provided in a slot 56 in the stationary frame 12. The cam 54 is formed with a peak **54*a* which, as the roller 50 rolls over it, causes the rightward movement (FIG. 2) of the entire drive arm/feed arm assembly 44, 30. At this same time, the feed arm 30 has dropped due to the frictional engagement of the descending drive arm 44 with the feed arm 30. A spring shoe 58, mounted on frame 12, urges the wheel 50 leftwardly. The spring shoe 58 is pivoted to the frame 12 by a pin 60. The shoe 58 is urged leftwardly by a spring 58*a* disposed between the shoe 58 and the frame 12**.

Mounted on the front end of the arm 30 is a feed knife 57 or blade means which serves, as it moves down and rightwardly (FIG. 2), to engage between adjacent fastener elements E of the line of fastener elements to move the entire line a short distance rearwardly in the sewing machine.

Figure 7A:
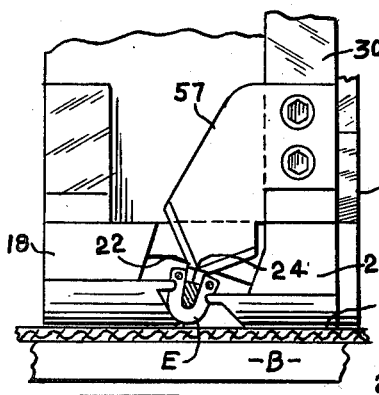
FIG. 7*a* is an enlarged fragmentary front end view of the knife and related parts in the position shown in FIG. 7.
Figure 7:
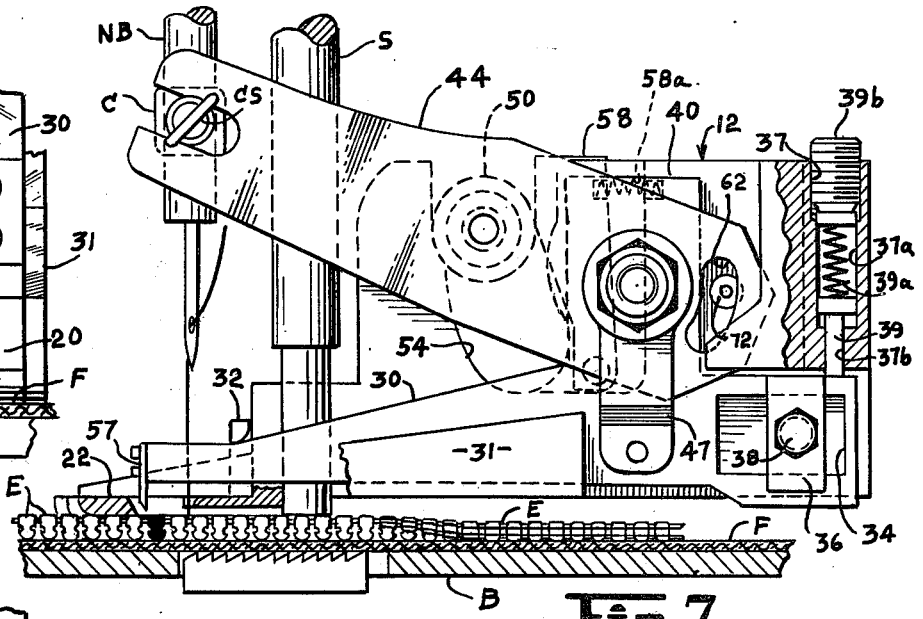
FIG. 7 is a sectional view showing the engagement of the feed and cut-off knife with a line of fastener elements.
Figure 8A:
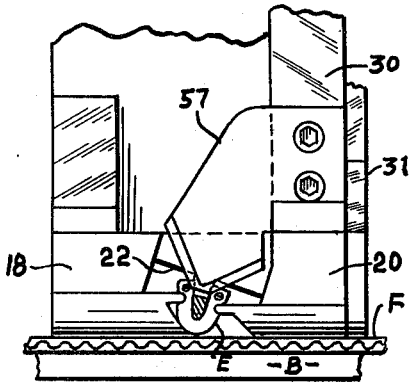
FIG. 8*a* is an enlarged fragmentary end view of the knife and related part in the position shown in FIG. 8.
Figure 8:
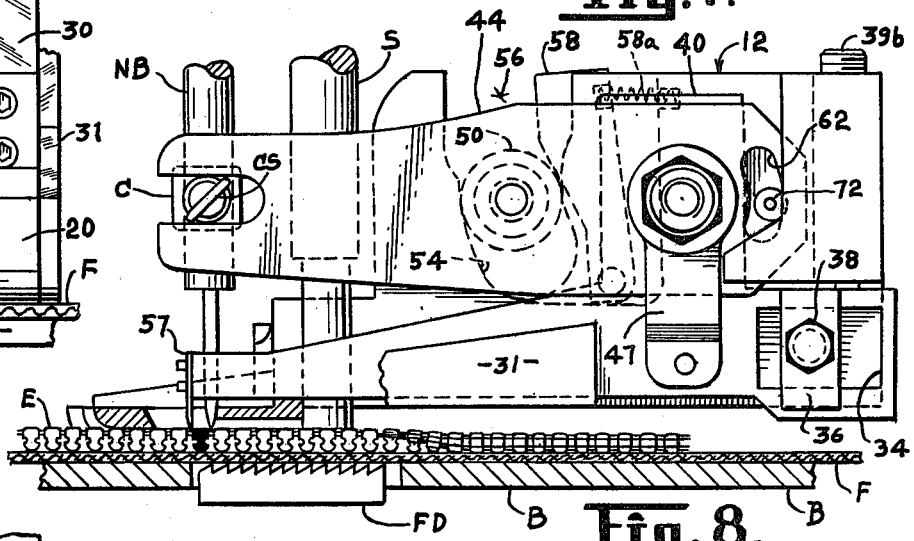
FIG. 8 is a sectional view similar to FIG. 7 but showing the feeding process further advanced with the knife having fed one of the fastener elements (blackened for easy recognition)

In operation, preferably the feed arm 30 reaches its rearward limit as the needle shaft reaches its lower limit. Then, as the shaft raises, the arm 44 is correspondingly driven up. This causes the front end of the arm 30 to raise. As the needle N moves farther upward, the spring shoe 58 urges the arm 44 forwardly (FIG. 7) causing the knife to move forwardly also.

It will be understood that as the arm 30 and knife 57 is making its hoe-like motions, pulling in step-by-step fashion the fastener line through the machine, the needle N is appropriately synchronized with this motion to sew the fastener elements E, one-by-one, to the fabric F.

CUT-OFF ACTION

Mechanism for cutting off the line of slide fastener elements E includes the feed arm 30 and the knife 57 as already described. It will be noted that the rightward end (FIG. 2) of the drive arm 44 is formed with a slot 62. On the other side of the frame 12 there is mounted an electric solenoid 70 having an armature comprising a pin 72. The pin is biased in the retracted condition by the spring 73 and stop element 74 limits the retroactive travel of the pin (FIG. 1).

Upon actuation of the solenoid 70, the pin is driven into the slot 62. The pin has a tapered front end (FIG. 2) so that even though, as shown in FIG. 2, the pin is not precisely aligned with the slot, the driving action by the solenoid 70 causes the pin to wedge into the opening 62 and to move the drive arm 44/feed arm assembly in a rightward direction. This is done against the bias of the spring shoe 58.

Figure 9A:
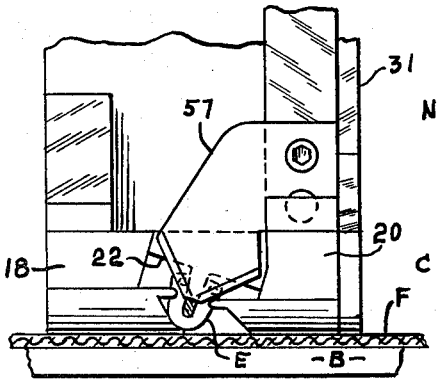
FIG. 9*a* is an enlarged fragmentary view of the knife and related part in the position shown in FIG. 9.
Figure 9:
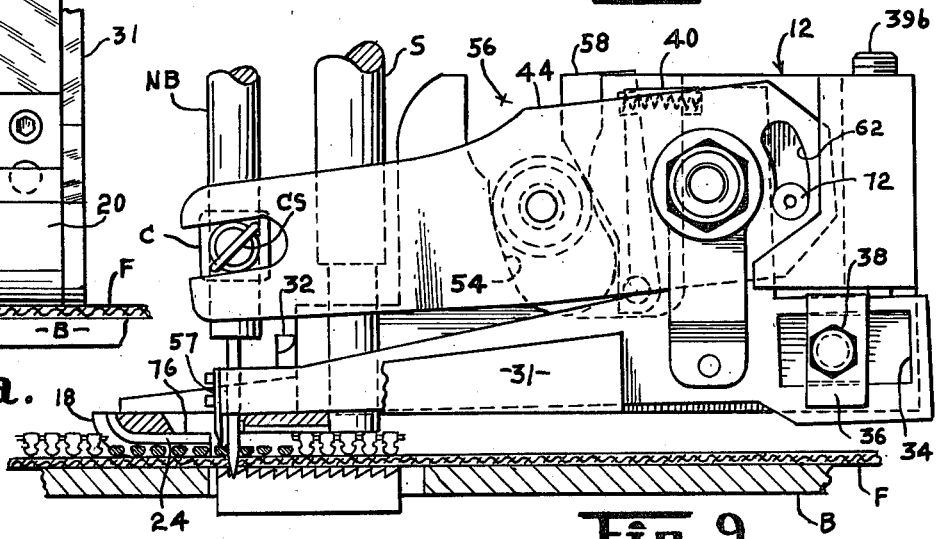
FIG. 9 is a view comparable in FIGS. 7 and 8 but showing the needle fully depressed with the cutter pin extended to cause the severing of the line of fastener elements.

The rightward movement as described causes the knife 57 to assume a new rightward position (FIG. 9) at which the knife is free to be driven all the way down to sever connecting cords of the line of slide fastener elements between adjacent elements (FIG. **9*a*). It will be understood that the knife 57 is normally held above such a lower level by the horizontal retaining guide means 76 (FIG. 9) comprising the upper surface of cam 24. This means normally prevents the movement of the knife 57 to a level sufficiently low so that the line of fasteners are severed. However, as shown in FIG. 3, the guide means 76 terminate just rightward of the normal end of travel of the feed knife 57. Hence, the normal reciprocation of the knife 57 is at a level whereat the cords holding the fastener elements E together are not engaged or cut thereby: the knife normally only engages between adjacent elements E and steps the line along. It is only upon actuation of the solenoid 70 and penetration of the slot 62 by the pin 72 which drives the assembly 30, 44 rightward to its limit which permits the severing position of the knife 57**.

It will be clear that after the severing of the cords M, the continued activation of the solenoid with the machine operating will cause the continued stitching of the machine and the continued advancing of the fabric F, but no feeding of the line of elements E. This enables the machine to make so-called anchoring stitches before and after the sewing of the line of elements E.

MODIFICATION OF THE INVENTION

Figure 10:
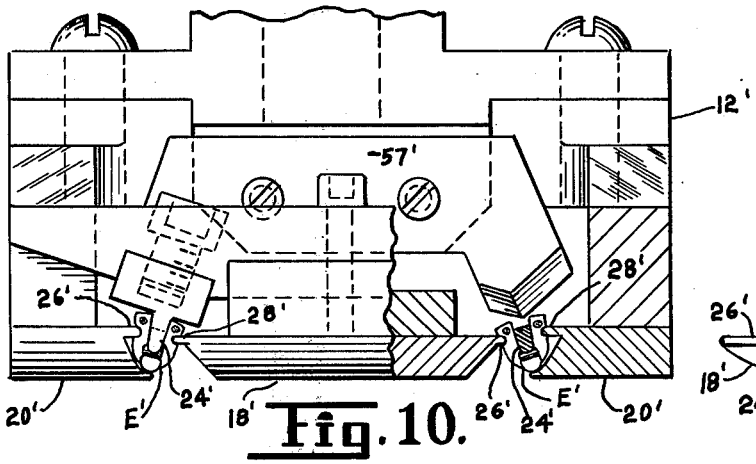
FIG. 10 is a front end view of a modified apparatus adapted for sewing side-by-side lines of fastener elements. This view is partly in section to show the relationship of the feeding knife with the lines.
Figure 11:
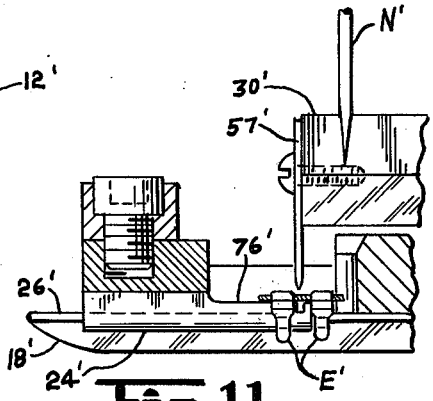
FIG. 11 is a side view partly in section and fragmentary showing the apparatus of FIG. 10.

The basic principles and operation of the feeding and severing foot for zipper lines having been now explained, the modification shown in FIGS. 10 and 11 should be readily understandable.

In the FIGS. 10–11 embodiment, the primed form of the same reference numerals used in the FIGS. 1 through 9 embodiment are employed where applicable.

Reference is made to FIG. 10 which is a front view of a presser foot embodying the invention and having dual fastener line feeding and severing capabilities. In this modification, the frame 12' supports a pair of fastener element-spreader cams 24' and element guide rails 26', 28' formed in the shoe structure 20', 18'. The front end of a feed arm 30 is formed with a pair of unitary knives 57'. As in the FIGS. 1 through 9 embodiment, the knives 57', when supported on the guides 76 and are driven in their hoe-like fashion, serve to step the lines of spaced side-by-side elements E' along. Upon the activation of the solenoid (not shown) the arm 30' and knife 57' move to its more rightward position and operate rightward of the guide 76' to accomplish the severing of the cords of the lines of fasteners simultaneously.

Figure 12:
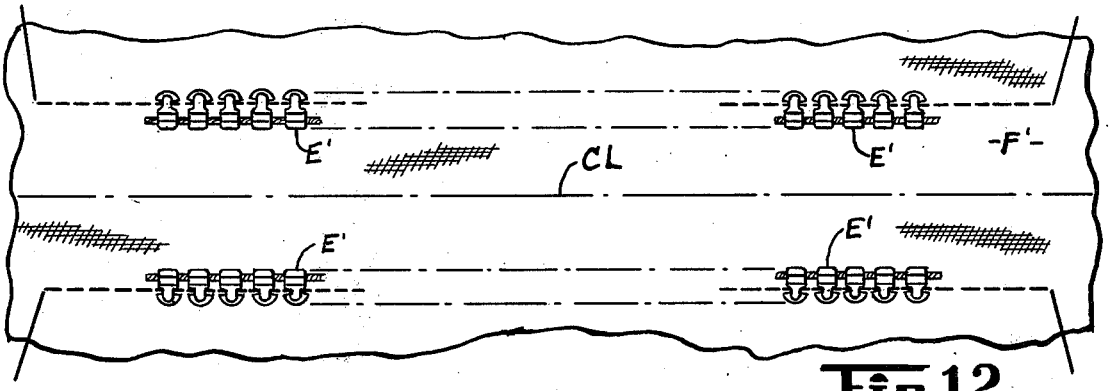
FIG. 12 is a view showing lines of fastener elements attached to a single piece of fabric as is accompanied by the modification shown in FIGS. 10 and 11.
Figure 13:
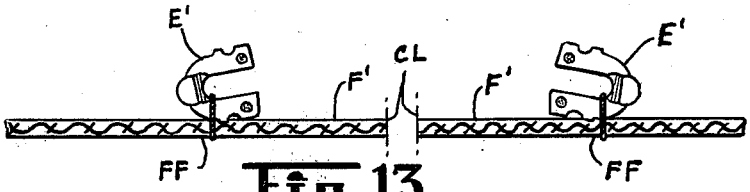
FIG. 13 is an enlarged sectional view of the product shown in FIG. 12, the fabric having been cut intermediate the lines.

With the apparatus shown in FIGS. 10 and 11, lines of side-by-side spaced parallel fasteners may be stitched directly to a layer of fabric as shown in FIG. 12. As shown, the relative canting of the two elements E' shown in FIG. 10, dispose the lines of fasteners in opposite fashion (FIG. 12), that is, with the heads of the fastener elements pointing outward with respect to the other line of fasteners. The intermediate product, therefore, is as shown in FIG. 13, a pair of fastener lines with their "U"-shaped openings opposing each other.

Figure 14:
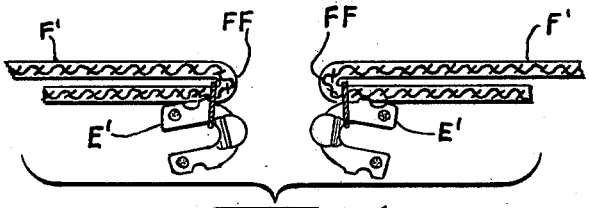
FIG. 14 is a further step towards completion of the product shown in FIG. 13 wherein the fabric is folded to dispose the lines of fastener elements on the inside of the fabric in invisible fashion.
Figure 15:
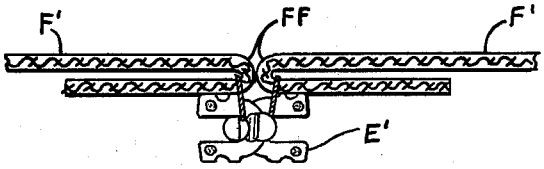
FIG. 15 shows in sectional view the fastener of FIG. 14 with its lines interlocked.
Figure 16:
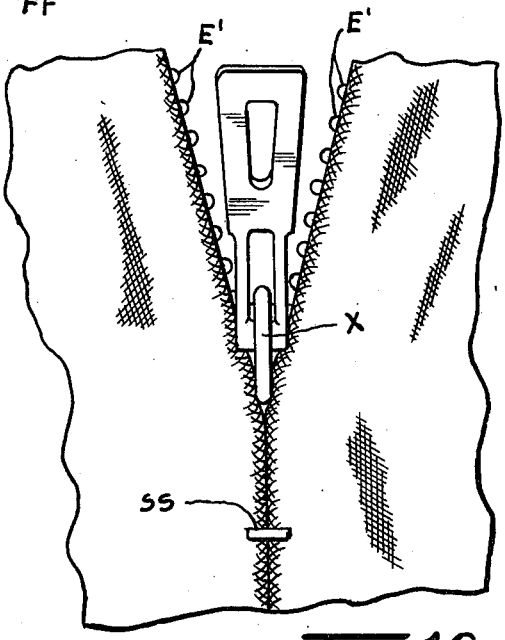
FIG. 16 is a view of the fabric in assembly of FIG. 15 showing the zipper slider and an end stop.

As shown in FIG. 3, the fabric F between the elements may then be cut on a line parallel to and intermediate the two lines (see the broken line CL in FIG. 12 indicating the cut line). In the next step in the garment manufacturing process, the fabric F may be folded at the positions FF just outside of the lines of fastener elements E', yielding the further intermediate product shown in FIG. 14. Finally, a slider X may be applied and the lines of elements E' intermeshed thereby, as shown in FIGS. 16 and 15. A conventional slider stop SS may be applied at the fabric joint and further stitching done along the line of severance, as will be understood by one skilled in the art.

Thus, using the dual applicator described in FIGS. 10 and 11, there is provided means for economically producing, without use of the conventional intermediate tapes, an invisible-type fastener directly attached to the fabric of a garment. Those in the trade will appreciate the elimination of the expensive and time-consuming intermediate steps including the previously thought necessary provision of slider elements already affixed to intermediate tapes. Obviously, the apparatus and method of the present invention offers profound advantages over conventional processes.

CONTROL MEANS FOR APPARATUS EMBODYING THE INVENTION

Figure 17:
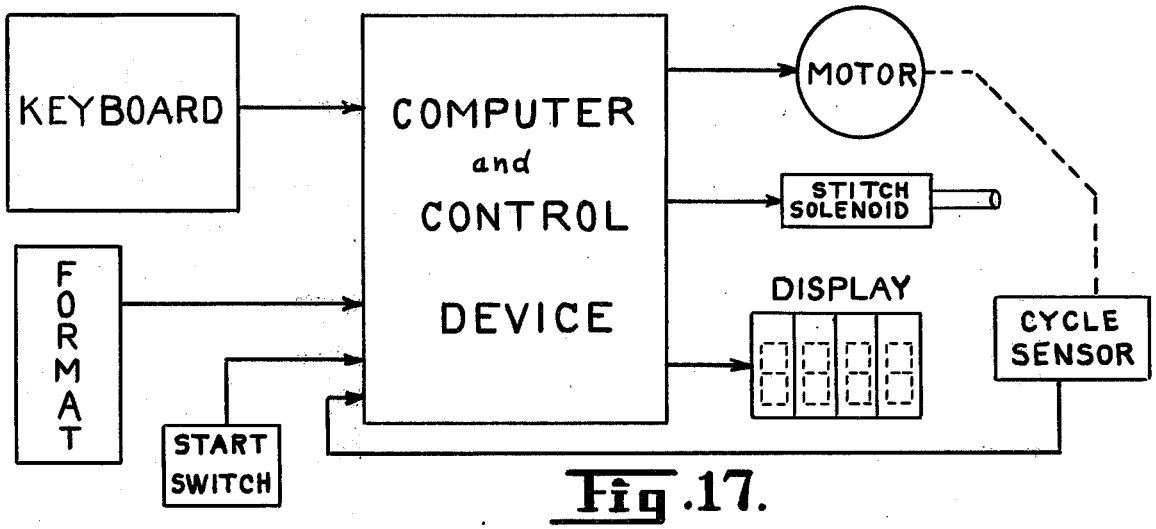
FIG. 17 is a block diagram showing the system employing the apparatus disclosed in FIGS. 1 through 11.
Figure 18:
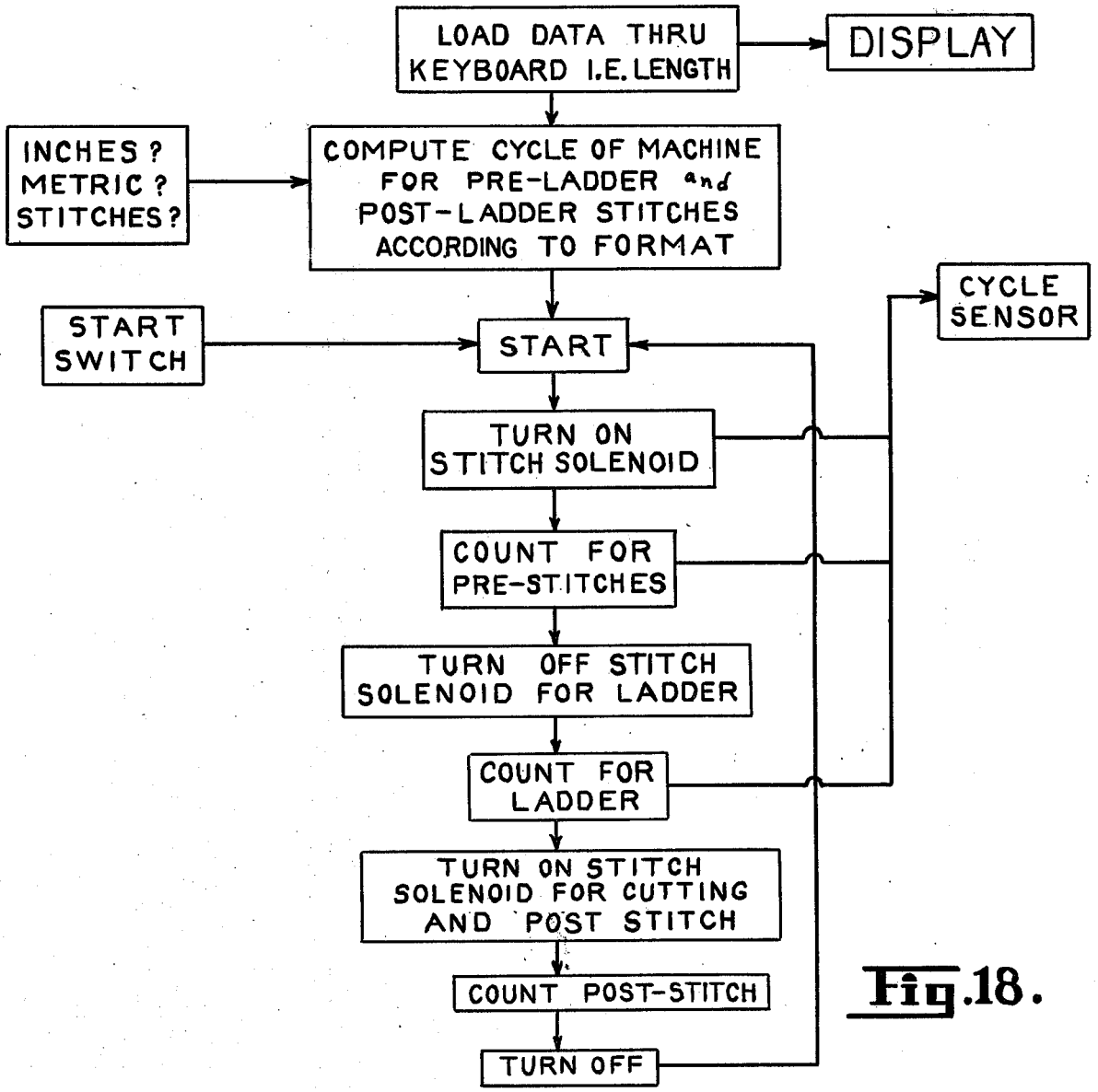
FIG. 18 is a block diagram showing the various steps in the process using the system of FIG. 17.

FIGS. 17 and 18 show in self-explanatory fashion in block diagram, the controls for apparatus embodying the invention.

Referring to FIG. 17, a keyboard is connected to a computer/control device which in turn is connected to the sewing machine motor as well as to a cycle sensor capable of counting the number of rotations of the main shaft of the sewing machine.

In an actual commercial embodiment, the computer/-control device takes the form of an instrument known in the trade as a "Microprocessor" and is available from the Pro-Log Corporation of Monterey, California, and bearing the model number PLS-402.

Additional connections to the computer/control device lead to the stitch solenoid 70, a start switch, a digital display element indicating the number of stitches the computer/control device is set for in accordance with the pre-programmed length fed in by the keyboard and a format circuit which establishes a general program for the machine's operation.

Now referring to FIG. 18, the method of operating the machine, including the circuitry set forth in FIG. 17, is presented.

As will be understood, prior to operation the keyboard is used to feed into the computer/control device information basically including the desired length of the zipper. The preestablished format circuitry establishes from this information the number of stitches involved and also presents to the computer/control device the number of end stitches which serve to provide stitching to the fabric prior to and subsequent to the actual stitching of the line of fasteners so that at either end of the line there are additional securing stitches to avoid the inadvertent working free of the ends of the fastener lines.

Pursuant to the instructions fed to the machine by the computer/control device, the commencement of the stitching operation is effected with the solenoid 70 activated. The activation of the solenoid causes, as the needle end reciprocates, the blade 75 to simply reciprocate in its cutting position without effecting any feeding of the fastener element line.

When the cycle sensor has counted the appropriate number of pre-stitches, the computer/control device automatically deactivates the solenoid 70 so that in subsequent reciprocations of the needle, the drive arm 44 drives the feed arm 30 and in the aforedescribed hoe-like motions feeding the line of fasteners at each reciprocation of the needle, with the needle correspondingly stitching the individual elements to the fabric F.

When the cycle sensor has counted the pre-determined number of rotations of the sewing machine drive shaft which equate to the number of inches of zipper to be installed, the computer/control device activates the solenoid 70 to cause the cutting operation of the line of elements E as aforedescribed.

Finally, with the solenoid 70 activated, the solenoid and the knife 57 reciprocating in its cutting position without feeding of any lines of element, the final or post stitches are counted out by the sensor prior to the shutting down of the machine.

It will be apparent that the improved apparatus and method as described represent a tremendous advance in the art which effects new economies in the manufacture of garments and improves quality of the final product.

While the apparatus as described is disclosed in a limited number of embodiments, it should be clear that the invention is not so limited but may take numerous variations, the apparatus and method all falling within the scope of the following claim language or equivalents thereof.

I claim:

1. An apparatus for affixing a line of zipper fastener elements to the material of a garment or the like, the line of zipper elements comprising a plurality of "U"-shaped plastic elements each having at its bight an enlarged head and a pair of parallel legs, the elements being held in spaced aligned relation by a pair of cords bonded in the respective legs of each element, the apparatus comprising a sewing machine, means for holding the line with the "U"-shaped elements with their heads down against the fabric so that the needle of the sewing machine can pass over the successive legs and stitch them to the fabric, reciprocating blade means driven by the sewing machine for feeding the fabric and line step-by-step fashion through the sewing machine, engaging means selectively actuateable for deepening the reciprocation of the blade means to sever the line of fasteners.

2. In an apparatus as claimed in claim 1, the improvement wherein the apparatus includes means for counting the elements as they are sewn on the fabric and for actuating the engaging means after a selected number of elements have been sewn.

3. In an apparatus as claimed in claim 2, the improvement wherein the apparatus includes means for terminating the sewing operation a selected number of stitches after the line of elements have been severed.

4. An apparatus as claimed in claim 2 wherein the feed means comprises a hoe-type structure driven by the sewing machine in hoe-like movements successively engaging with its blade behind successive elements to pull them through the machine.

5. An apparatus as claimed in claim 4 wherein the hoe-type structure when engaged by the engaging means makes a deeper stroke and its blade drops to sever the cords of the line of fastener elements whereby the feed means comprises the severing means.

6. For a sewing machine, an attachment adapted to sew a line of zipper fastener elements onto the fabric of a garment, the line comprising a series of "U"-shaped elements each having an enlarged head on its bight and a pair of parallel legs, the elements being held in appropriate spaced aligned relation by a pair of parallel cords embedded respectively in the respective legs of the elements, the attachment comprising a body, guide means for guiding the line through the machine with the head down on the fabric and the legs directed upward, line feed and line severing means including a hoe-like element pivotally attached to the body, a driving element connected to the needle-driving means of the sewing machine and to the hoe-like element to drive the hoe-like element in hoe-like strokes as the needle reciprocates, the blade of the hoe-like element facing the line adapted to engage behind the elements, one after another, and pull them into the machine as the needle reciprocates, and engagement means which when actuated permits the hoe-like element to make a deep stroke to sever the cords on the line of fasteners.

7. An attachment for a sewing machine as claimed in claim 6, wherein the engagement means includes solenoid means and associated means which when in engaged position alters the hoe-like stroke of the hoe-like means for the severing operation.

8. An apparatus for affixing a line of zipper fastener elements to the material of a garment or the like, the line of zipper elements comprising a plurality of "U"-shaped plastic elements aach having at its bight an enlarged head and a pair of parallel legs, the elements being held in spaced aligned relation by a pair of cords bonded in the respective legs of each element, the apparatus comprising a sewing machine, means for holding the line with the "U"-shaped elements with their heads down against the material so that the needle of the sewing machine can pass over the successive legs and stitch them to the material, L-shaped reciprocating and translating means driven in time with the sewing machine, one leg of the L-shaped means being substantially horizontal and the other leg depending from the front of the one leg and including a blade portion, said other leg being adapted to engage the line adjacent the needle for feeding the line step-by-step fashion through the sewing machine by engaging the elements successively as the L-shaped means reciprocates and translates, means selectively actuateable for deepening the reciprocation of at least the blade portion of the L-shaped means to sever the cords.

9. An apparatus for affixing a line of zipper fastener elements to the fabric of a garment or the like, the line of zipper fastener elements comprising a plurality of "U"-shaped plastic elements each having at its bight an enlarged head and a pair of parallel legs, the elements being held in spaced aligned relation by a pair of cords bonded in the respective legs of each element, the apparatus comprising a sewing machine, means for holding the line with the "U"-shaped elements with their heads down against the fabric so that the needle of the sewing machine can pass over the successive legs and stitch them to the fabric, reciprocating line-engaging means including a blade portion driven in timed relation to the needle of the sewing machine for feeding the line step-by-step fashion through the sewing machine, means selectively actuateable for deepening the reciprocation of at least the blade portion of the line-engaging means to sever the line of fasteners.

* * * * *